United States Patent [19]

Silvestris et al.

[11] 4,087,147

[45] May 2, 1978

[54] TRACK LIGHTING SYSTEM CONNECTOR

[75] Inventors: Louis F. Silvestris, Bayonne; Arthur Silverman, Short Hills, both of N.J.

[73] Assignee: Keene Corporation, New York, N.Y.

[21] Appl. No.: 753,850

[22] Filed: Dec. 23, 1976

[51] Int. Cl.[2] ..... H01R 9/00; H01R 13/60

[52] U.S. Cl. ..... 339/21 R; 339/95 D

[58] Field of Search ..... 339/21 R, 22 R, 22 B, 339/95 R, 95 D

[56] References Cited

U.S. PATENT DOCUMENTS

| | | | |
|---|---|---|---|
| 3,634,809 | 1/1972 | Joly | 339/22 R |
| 3,786,394 | 1/1974 | Koenig | 339/22 B |
| 3,831,130 | 8/1974 | Valtonen | 339/21 R |
| 3,871,730 | 3/1975 | Hesse | 339/21 R |

*Primary Examiner*—Neil Abrams

*Attorney, Agent, or Firm*—Kane, Dalsimer, Kane, Sullivan and Kurucz

[57] ABSTRACT

A connector for use in a track lighting system is provided. The connector comprises a housing formed of at least two nonconductive members one overlying the other. A cavity extends through the housing at the interface of the members and terminates in openings at opposite ends of the connector. A contact is positioned within the cavity and is designed to permit a conductor to enter the cavity through an opening but resists removal of the conductor from the opening. The housing is held together by two fasteners one of which has a coil spring wound about it so that when the fastener is loosened, the coil spring serves to urge the housing members apart to thereby enable the contact to disengage from the conductor.

4 Claims, 6 Drawing Figures

FIG. 1
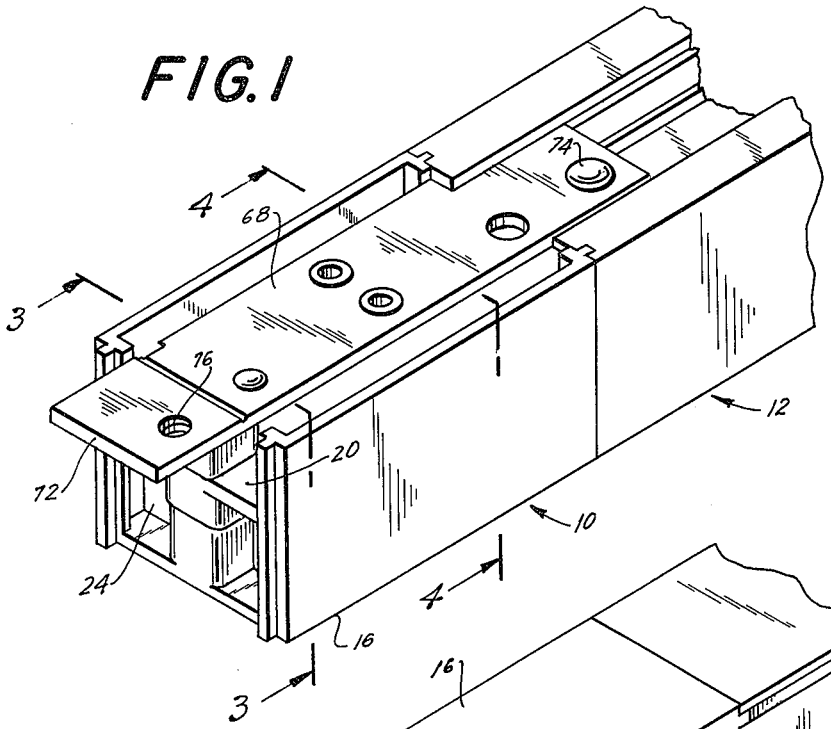
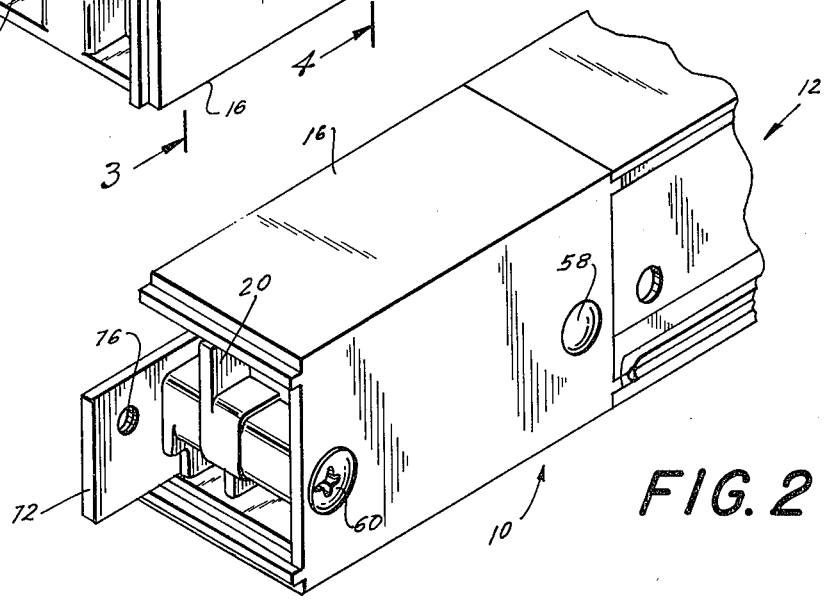
FIG. 2
FIG. 5
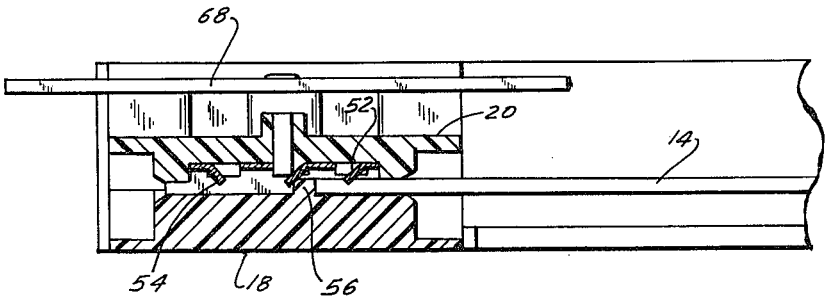

TRACK LIGHTING SYSTEM CONNECTOR

BACKGROUND OF THE INVENTION

The present invention relates to track lighting and more particularly to a connector for use in joining sections of track to one another.

Track lighting has become increasingly popular in both inudstrial and domestic applications. Such lighting systems utilize a track within which elongated electrical conductors are positioned. Fixtures may be mounted at any position along the track drawing current from the elongated conductors. The tracks are generally sold in fixed lengths and very often, two or more such lengths of track must be butt joined together to obtain the overall length of track desired. In joining such lengths of track, it is necessary to make both physical connection and electrical continuity between the adjacent track sections and the conductors therein.

While several connector forms have heretofore been proposed, such prior art connectors, in the main, require that considerable time be spent by the electrician in the field installing and making the necessary connections through the connector. This, of course, greatly adds to the cost of the final installation.

In view of the above, it is the principal object of the present invention to provide an improved connector for use in track lighting systems which may readily and quickly be installed is position to connect adjacent sections of track together.

A further object is to provide such a connector which may readily be "broken" to permit disconnection of the track sections if required and thereafter may be reused for connection.

A still further object is to provide such a connector which may also be used at the ends of a run of track to permit connection of the track with a power supply or to complete a run.

SUMMARY OF THE INVENTION

The above and other beneficial objects and advantages are attained in accordance with the present invention by providing a connector for use in a track lighting system wherein the connector comprises a housing formed of at least two nonconductive members one overlying the other. A cavity extends through the housing at the interface of the members and terminates in openings at opposite ends of the connector. A contact is positioned with in the cavity and is designed to permit a conductor to enter the cavity through an opening but resists removal of the conductor from the opening. The housing is held together by two fasteners one of which has a coil spring wound about it so that when the fastener is loosened, the coil spring serves to urge the housing members apart to thereby enable the contact to disengage from the conductor.

BRIEF DESCRIPTION OF THE DRAWINGS

In the accompanying drawings:

FIG. 1 is a perspective view of a connector in accordance with the present invention attached to a fragmented section of track and depicting the top, one side and an end of the connector;

FIG. 2 is a view similar to FIG. 1 depicting the bottom, a side and an end of the connector;

FIG. 5 is a sectional view taken along reference lines 5—5 of FIG. 4 in the direction indicated by the arrows; and, FIG. 6 is an exploded view showing the various components of the connector.

DETAILED DESCRIPTION OF THE PREFERRED EMBODIMENT

Reference is now made to the accompanying drawings wherein a preferred embodiment of the present invention is depicted. In FIG. 1, a connector 10 in accordance with the invention is shown in place at the end of a section of track 12. The track 12 is of conventional construction and comprises an elongated channel-like structure containing therein two or more elongated exposed conductors insulated from each other and the track body. In use, one or more fixtures are mounted to the track at desired locations and brought into electrical contact with the track conductors. A typical conductor 14 is shown in FIG. 5. As stated, the connector 10 serves to connect two such lengths of track 12 to one another and to provide the electrical continuity between the track conductors. In addition, the connector may serve as an end piece for a run of track and, as will be described forthwith, may also serve as the connection point between the track and power supply to which the track is to be connected.

Figure 6:
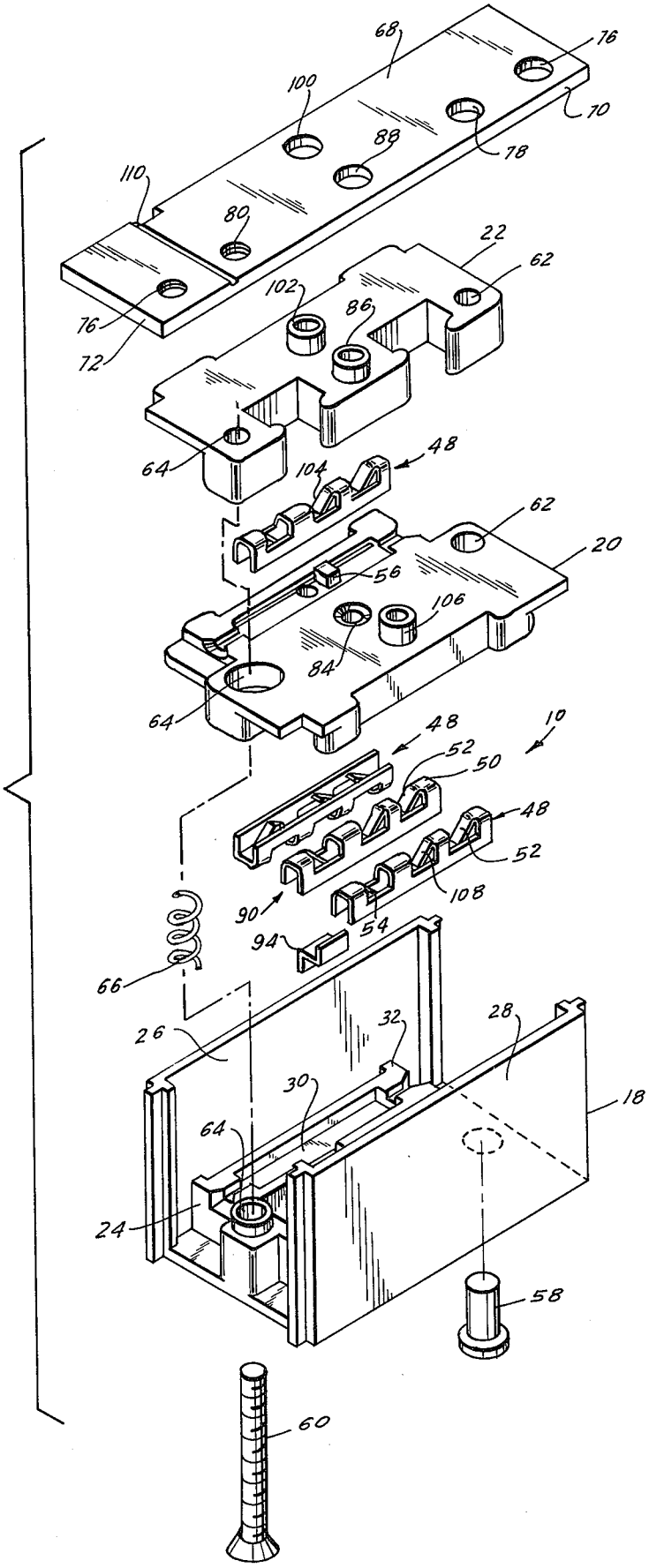

Referring to FIG. 6, it can be seen that the connector 10 comprises a housing generally designated by the numeral 16 which is formed of a base member 18, intermediate member 20 and top member 22. Each of the housing members is formed of an insulating plastic material. The overall configuration of the housing is rectangular and its dimensions are such that when the connector abuts a section of track as shown in FIGS. 1 and 2, the sides, bottom and top of the housing form extensions of the track.

Housing member 18 comprises a bottom portion 24 with integral sidewalls 26 and 28 extending upwardly therefrom. A longitudinally extending depression 30 is formed in the top surface 32 of the bottom portion 24. The depression extends across the bottom portion 24 and, in the assembled housing, mates with a corresponding, although shallower impression 34 (seen best in FIG. 4) in the bottom surface of the intermediate member 20. The depression 30 and impression 34 cooperate in defining a cavity 36 which extends across the housing at the interface of members 18 and 20. The cavity terminates in an opening 38 at each end of the housing.

In a similar fashion, a cavity 40 is also provided at the interface of members 18 and 20 terminating in openings 42 at the ends of the housing and a cavity 44 is provided at the interface of members 20 and 22 terminating in openings 46.

Positioned within each of the cavities 36, 40 and 44 there is provided an electrical contact 48 formed of a suitably conductive material such as copper. The contacts are elongated elements generally U-shaped in section. A series of tabs are cut in the base 50 of the U with the tabs bent to extend into the space between the sides of the "U". As will be described forthwith, these tabs yield in one direction to permit a conductor to be readily inserted into the associated cavity in that direction but resist movement in the other direction and thus preclude the removal of the conductor from the cavity. In this regard, it should be noted that the tabs 52 and 54 at opposite ends of the contact are connected to base 50 to form minor images of each other. That is, (reference being made to FIG. 6) tab 52 has a free left end and is connected to the base at its right end while tab 54 has a free right end and is connected to base 50 at its left end.

Figure 4:
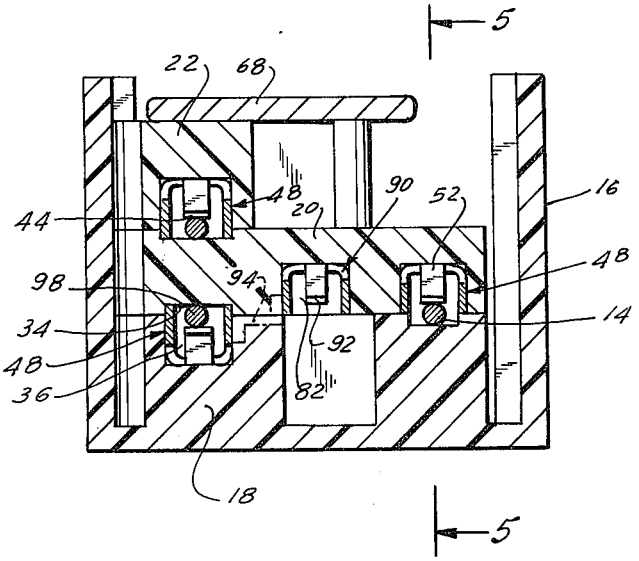
FIG. 4 is a sectional view taken along reference lines 4—4 of FIG. 1 in the direction indicated by the arrows.

As seen most clearly in FIGS. 4 and 5, contacts 48 are positioned in each of cavities 36, 40 and 44 with the tab extending substantially across the depth of the cavity. Since the tabs are cantilevered so that their free ends are across from their associated openings, as a conductor is inserted through any of the openings 38, 42 or 46, (or for the corresponding openings on the opposite side of the housing) the tab yields to the conductor as the conductor is inserted into the opening. The tab is sufficiently resilient to wipe across the conductor. This wiping of the tab against the conductor assures a good electrical contact between the tab and conductor without resisting insertion of the conductor into the opening. If an attempt were made to remove the conductor the tab would oppose the removal of the conductor by acting as a barb or wedge to bite into the conductor and resist such removal. The action is somewhat similar to that of a ratchet and pawl mechanism. This may best be seen from a consideration of FIG. 5 from which it should be apparent that tab 52 does little to impede the insertion of conductor 14 into cavity 40. However, if an attempt were made to remove conductor 14 (i.e., by pulling the conductor to the right as shown in the figure) the tab 52 would resist such motion. Similarly, a conductor may be inserted into the opening from the opposite side in which event tab 54 would permit such insertion but would resist removal. In order to control the degree of insertion of a conductor within the various cavities, stops 56 are provided molded integral with the housing members.

The components of housing 10 are maintained in position by a pair of fasteners 58 and 60 extending through the housing at opposite ends. For reasons which will be discussed shortly, fastener 58 may be a permanent fastener such as a rivet while fastener 60 is a removble fastener such as a screw. Suitable guide holes 62 and 64 are provided in the various members to receive fasteners 58 and 60. The operation of the connectors described above can only work so long as the members of the housing are tightly held together since if members 18 and 20, for example, are permitted to separate, the cavity depth dimension will increase to the point where the tabs no longer wipe against an inserted conductor nor resist removal of the conductor.

Figure 3:
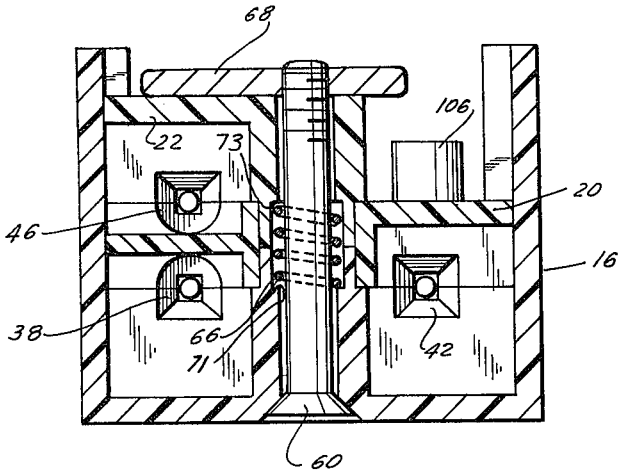
FIG. 3 is a sectional view taken along reference lines 3—3 of FIG. 1 in the direction indicated by the arrows.

Since it is sometimes desirable to remove a conductor, as for example to dismantle connected sections of track, a spring 66 is provided biased to separate the top and bottom members 18 and 22 respectively as shown in FIG. 3. Thus, in normal use, when the connector is fully assembled screw 60 is tightly fastened into top plate 68 as is rivet 58. The dimensions of the cavities will now be such as to preclude the removal of a conductor from an opening in the manner described above. If screw 66 is loosened just a few turns, spring 66 will bear on flanges 71 and 73 of top and bottom members 22 and 18 respectively thereby separating them and, in doing so, enlarging the various cavities. As a result of the above action, any conductor within an opening on the side of the connector containing screw 60 may readily be removed. It is contemplated that a connector will be permanently mounted to one end of a section of track 12 as shown in FIG. 1. Accordingly, the opposite fastener 58 may be a rivet to insure that the conductors associated with section 12 are not accidentally removed from the connector.

The assembled connector is provided with top plate 68 which comprises a metallic member that overlies the connector 10 and has extended end sections 70 and 72 respectively which overlie portions of the sections of track to be connected. A screw or rivet 74 may be inserted through an opening 76 in the extensions 70 and 72 to secure the connector to the track sections. Plate 68 also contains an opening 78 to receive rivet 58 and a threaded opening 80 to receive the threaded end of screw 60.

As stated at the outset, connector 10 may be used either to connect adjacent sections of track together in which case physical connection between the track sections is made through fasteners 74 extending through opening 76 in top plate 68 as shown in FIGS. 1 and 2 while electrical continuity is maintained by placing the corresponding conductors of each track section into the connector openings so that continuity may be made through the contacts. At the end of a run of track, the connector 10 may be used to connect the track run with a power source. To this end, an additional cavity 82 is molded in the intermediate housing member 20. Unlike the other cavities, cavity 82 does not terminate in openings at the ends of the housing. A vertical passage 84 extends through member 20 in alignment with a similar vertical passage 86 in member 22 which, in turn, is aligned with an opening 88 in plate 68. A contact 90, identical in construction with contacts 48, is positioned within cavity 82 and aligned so that at least one tab 92 aligns itself with opening 84. A stepped conductive member 94 extends between contact 90 and the contact in cavity 36 in the manner shown in FIG. 4. Thus, a conductor inserted through opening 88 will pass through passages 86 and 84 to engage contact 90 via tab 92 and thereafter through member 94 this conductor will be brought into electrical continuity with the contact in cavity 36 to maintain continuity with any conductor 98 within this cavity.

In a similar fashion, a conductor may be fed through opening 100 in plate 68 through passage 102 in member 22 to engage the center tab 104 of the contact 48 positioned in cavity 44. Likewise, a conductor may be fed through opening 106 in member 20 to engage the central tab 108 of the contact in cavity 40.

It should be realized that in each case, when the connector 10 is fully assembled and tightened to overcome the biasing force of spring 66, once a conductor is inserted through an opening so as to pass the tab of an associated contact, that conductor can no longer be removed until the screw 60 is loosened sufficiently to enable spring 66 to urge the members 18, 20 and 22 apart. When the members are so urged apart, the conductors can readily be removed from the openings at the end of the housing containing screw 60 as well as the top openings. As stated, it is contemplated that the connector will be permanently attached to a length of track and thus rivet 58 is provided to prevent removal of the connector from that length of track. In cases where the connector 10 is used at the end of a run of track, the extension 76 on plate 68 may be removed. To this end, a score line 110 extends across the plate to facilitate removal of the extension merely by snapping it off.

Thus, in accordance with the above an improved connector attaining the aforementioned objects is described.

Having thus described the invention, what is claimed is:

1. A connector for use in a track lighting system, said connector comprising: a generally rectangularly shaped housing formed of at least two nonconductive members, one of said members overlying the other;

a first cavity extending through the housing at the interface of said members, said cavity terminating in at least two openings on the surface of the housing extending through opposite sides of said housing;

a first electrically conductive contact positioned within said cavity, said contact including a tab portion extending into a path aligned with one of said openings, said tab portion having surfaces contoured to engage and secure an electrical conductor positioned into said one opening and to pooise the removal of said electrical conductor from said one opening;

fastener means securing said housing members together thereby causing said contact portions to securely engage said electrical conductor, said fastener means including a first fastener at one of said opposite sides and a second fastener at the other of said opposite sides;

and, coil spring means disposed within said housing extending about one of said fasteners and biased to urge at least one of said members in the direction of the axis of said one fastener to facilitate separation of said members when said one fastener is loosened.

2. The invention in accordance with claim 1 further comprising a second cavity extending through the housing at the interface of said members, a second electrically conductive contact similar to said first contact positioned within said second cavity, said second cavity extending generally parallel to said first cavity.

3. The invention in accordance with claim 2 wherein said housing includes a top surface and further comprising paths extending through one of said members between said top surface and said cavities terminating in openings on said top surface whereby conductors may be fed through said top surface openings to said contacts.

4. The invention in accordance with claim 1 further comprising a third nonconductive member overlying said two members, another cavity extending through said housing at the interface of said third member and said two members, said other cavity terminating in at least two openings on said housing, and a contact similar to said first contact positioned within said other cavity.

* * * * *

UNITED STATES PATENT OFFICE
CERTIFICATE OF CORRECTION

PATENT NO. : 4,087,147

DATED : May 2, 1978

INVENTOR(S) : Louis F. Silvestris and Arthur Silverman

It is certified that error appears in the above-identified patent and that said Letters Patent are hereby corrected as shown below:

Column 3, line 41 "removble" should be --removable--.

Column 5, line 19 "pooise" should be --oppose--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*